US005161500A

United States Patent [19]

Kubis et al.

[11] Patent Number: 5,161,500

[45] Date of Patent: Nov. 10, 1992

[54] OUTLET VALVE LIFTER FOR AN INTERNAL COMBUSTION ENGINE

[75] Inventors: Heribert Kubis; Dieter Wittman, both of Nürnberg, Fed. Rep. of Germany

[73] Assignee: MAN Nutzfahrzeuge Aktiengesellschaft, München, Fed. Rep. of Germany

[21] Appl. No.: 827,799

[22] Filed: Jan. 29, 1992

[30] Foreign Application Priority Data

Jan. 29, 1991 [DE] Fed. Rep. of Germany ..... 4102537

[51] Int. Cl.[5] ..... F02D 13/04; F01L 1/14

[52] U.S. Cl. ..... 123/321; 123/90.16; 123/90.48

[58] Field of Search ..... 123/321, 90.12, 90.13, 123/90.14, 90.16, 90.48, 90.49, 90.55

[56] References Cited

U.S. PATENT DOCUMENTS

| | | | |
|---|---|---|---|
| 3,786,792 | 1/1974 | Pelizzoni et al. | 123/321 |
| 4,164,917 | 8/1979 | Glasson | 123/321 |
| 4,337,739 | 7/1982 | Jordan | 123/90.16 |
| 4,399,787 | 8/1983 | Cavanagh | 123/321 |
| 4,408,580 | 10/1983 | Kosuda et al. | 123/90.16 |

*Primary Examiner*—E. Rollins Cross

*Assistant Examiner*—Weilun Lo

*Attorney, Agent, or Firm*—Robert W. Becker & Associates

[57] ABSTRACT

An outlet valve lifter for internal combustion engine is described. In order to increase the braking power of the internal combustion engine it is necessary that the outlet valve is opened during the compression cycle. Advantageously, this is achieved by a hydraulic outlet valve lifter which is actuated by an external pressure source. Due to the pressure of the compressed air shortly before the ignition top dead center position great forces are acting on the outlet valve and accordingly on the outlet valve lifter. These forces, in the form of hydraulic pressure, act via the inner portion of the outlet valve lifter on the external pressure source and may cause damage. Therefore, the outlet valve lifter is provided with an inner portion which is lifted by a certain stroke due to the pressure actuation via a second pressure chamber so that the outlet valve opens. When the pressure within the second pressure chamber increases as a function of the forces acting on the outlet valve and surpasses the hydraulic pressure generated by the external pressure source, a ball valve closes the second pressure chamber so that the hydraulic pressure generated therein may not be transmitted to the external pressure source.

6 Claims, 3 Drawing Sheets

OUTLET VALVE LIFTER FOR AN INTERNAL COMBUSTION ENGINE

BACKGROUND OF THE INVENTION

The present invention relates to an outlet valve lifter for an internal combustion engine whereby the outlet valve lifter is arranged between an outlet cam and a valve push rod connected to an outlet valve and actuated by an external pressure source supplying a pressure medium.

In order to increase the braking power of internal combustion engines in commercial vehicles, it has been known to open the outlet valve during the compression cycle shortly before the ignition top dead center position is reached in order to release the air and thereby prevent back expansion. For opening the outlet valve before the ignition top dead center position is reached, a hydraulically actuated valve push rod is arranged between the outlet cam and the outlet valve which is actuatable by an external pressure source. Between the outer portion of the outlet valve lifter and an inner portion of the outlet valve lifter which is slidable inside the outer portion, a pressure chamber is provided which is connected via a bore to the pressure source. The pressure source is commonly in the form of a hydraulic pump unit. When it is desired to lift the outlet valve before the ignition top dead center position, the hydraulic pump unit is actuated and the pressure chamber is filled with the pressure medium so that the inner portion will lift the outlet valve via the valve push rod against the force of the valve spring, whereby the outlet valve lifter in this phase rests at the base circle of the cam shaft. The cam of the cam shaft only serves to lift the outlet valve during the outlet cycle. In the breaking operation of the engine, the outlet valve opens during the course of the compression cycle. Due to the increasing pressure during the compression cycle, the force that is exerted onto the outlet valve also increases. This force is transmitted via the valve push rod to the inner portion of the outlet valve lifter and results in a pressure increase which is substantially greater than the pressure required for opening the outlet valve against the force of the valve spring. This pressure is transmitted via all of the pressurized parts to the external pressure source and results in damage by cavitation, erosion, and leakage.

It is therefore an object of the present invention to prevent such detrimental increased pressures outside the valve lifter in order to expose all of the pressurized parts only to the relatively low pressure required for the additional lifting of the outlet valve so that damages are essentially prevented and a high operational safety over an extended service life is ensured.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
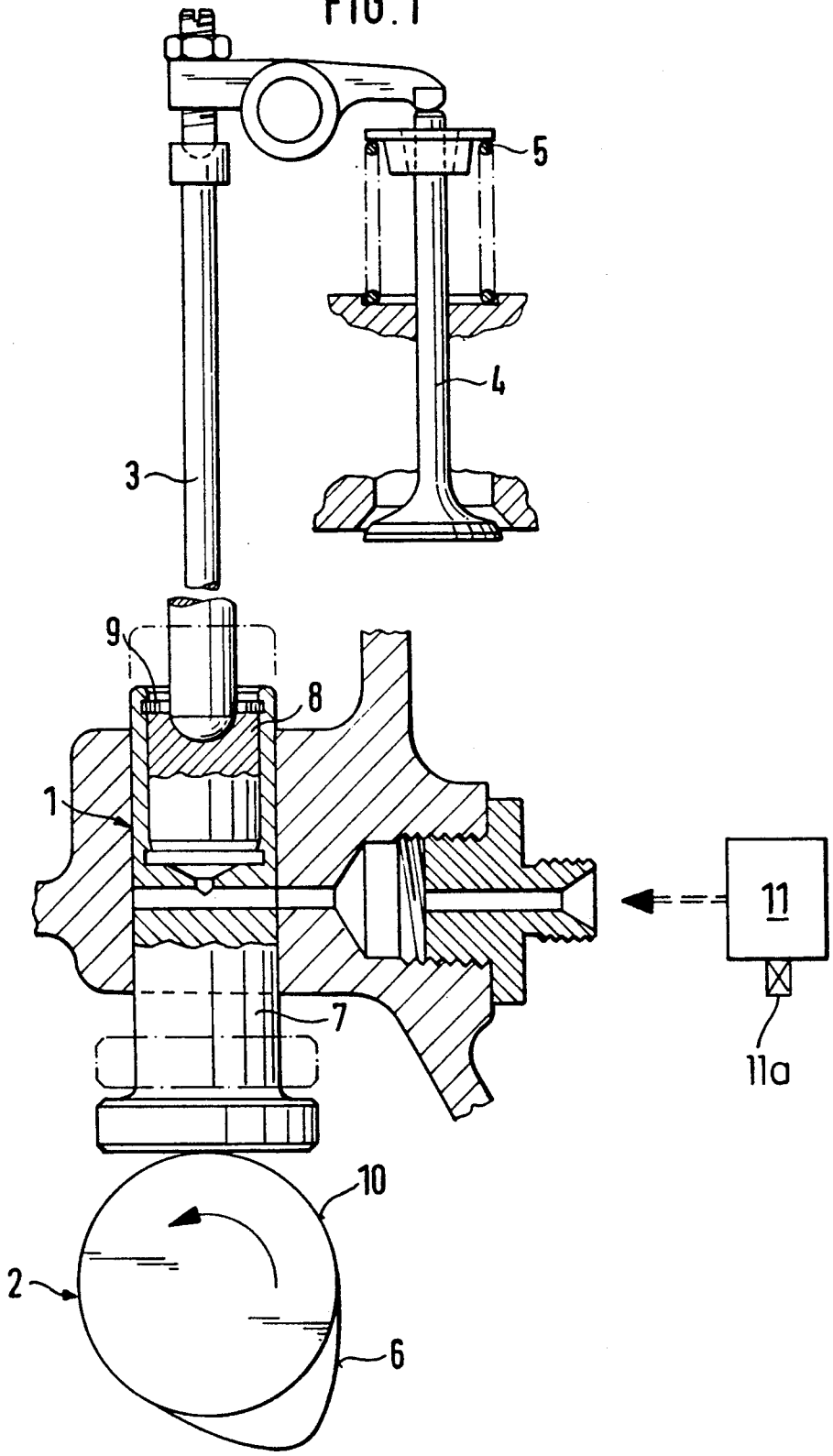
FIG. 1 is an outlet valve lifter arranged between the cam shaft and the outlet valve.

The outlet valve lifter of the present invention is primarily characterized by:

an outer portion and an inner portion, whereby the inner portion is axially slidable with play in the outer portion and is actuated by a pressure medium, and whereby the outer portion has a first radial bore and the inner portion has a second radial bore;

a housing in which the outer portion is axially slidable, the housing having a third radial bore connecting to the external pressure source;

a piston disposed axially slidable inside the inner portion:

a stroke limiting device in the area of a first end of the piston for limiting a stroke of the piston in a first direction toward the valve push rod;

a pin connected to a second end of the piston, whereby the pin limits the stroke of the piston in a second direction;

a pressure spring arranged at the first end of the piston, the pressure spring forcing the piston in the second direction into an initial position thereof;

a ball valve connected to the inner portion in the area of the second end of the piston, the ball valve comprising a ball, a valve seat, a spring, connecting bores and an axial bore, whereby the spring forces the ball toward the piston into said valve seat, with the pin of the piston being arranged in the axial bore and pressing against the ball in the initial position of that piston so that the valve seat is in an open position;

a first pressure chamber within the inner portion, the first pressure chamber being defined between the piston and the ball valve and communicating with the external pressure source via the first, second and third radial bores;

a second pressure chamber within the outer portion, the second pressure chamber being defined by inner walls of the outer portion and outer walls of the ball valve, whereby the first and second pressure chambers communicate with to one another via the axial bore, the valve seat and the connecting bores in the initial position of the piston;

wherein, when pressure medium is supplied, the piston, due to increasing pressure in the first pressure chamber, is moved against a force of the pressure spring in the first direction so that the ball is released and forced into the valve seat by the spring, thereby closing the valve seat, whereby the force of the spring is adjusted such that the pressure generated by pressure medium is sufficient to remove the ball from the valve seat and to allow pressure medium to enter the second pressure chamber and lift the inner portion for opening the outlet valve via the valve push rod;

wherein, when back pressure from the outlet valve acting via the valve push rod on the inner portion causes a pressure increase in the second pressure chamber, the ball is forced into the valve seat thereby closing the valve seat and preventing back flow of pressure medium to the external pressure source; and wherein, when the pressure generated by the pressure medium decreases, the pressure spring forces the piston into the initial position, in which the pin forces the ball into the open position of the valve seat, so that pressure medium contained in the second pressure chamber flows out and lifting of the inner portion and the outlet valve is terminated.

Due to the fact that the second pressure chamber below the inner portion may be closed off by the ball with respect to the pressurized parts of the device, a pressure level may be generated in said second chamber which may be a multiple of the pressure level required for opening the outlet valve without the external pressurized parts leading to the pressure source of the device being in contact with this increased pressure. Due to this inventive arrangement damage may be reliably prevented.

In a preferred embodiment of the present invention the stroke limiting device is in the form of an abutment which is fixedly connected to the piston. It is furthermore expedient that an annular abutment, connected to the outer portion, is provided for limiting the maximum stroke, having a corresponding play, of the inner portion in order to prevent a contacting of the outlet valve at an engine piston when the engine is operated at maximum revolutions, and that the external pressure source further comprises a relief pressure valve for releasing excess pressure medium, which has been pumped unnecessarily by the hydraulic pump unit of the pressure source due to the normal oil pressure that causes an additional stroke.

It is advantageous that the stroke is determined such that under normal braking conditions of the engine at a maximum additional stroke generated by the external pressure source a play between the inner portion and the annular abutment is present.

In another embodiment of the present invention the stroke limiting device is comprised of a first and a second control bore within the inner portion, an overflow channel connecting the first and the second control bores, and a relief bore within the outer portion. The first control bore is located within the area of the first pressure chamber such that, when a desired end position of the piston is reached, the first control bore is opened and the pressure chamber communicates via the overflow channel and the second control bore with the relief bore. It is expedient that the second control bore is arranged in the area of the pressure spring and that the relief bore has a further portion that is arranged in the inner portion in the area of the pressure spring, whereby the second bore and the relief bore with the further portion communicate via a space of the inner portion in which the pressure spring is arranged.

DESCRIPTION OF PREFERRED EMBODIMENTS

The present invention will now be described in detail with the aid of several specific embodiments utilizing FIGS. 1 through 5.

FIG. 1 shows an outlet valve lifter 1 arranged between a cam shaft 2 and a valve push rod 3. The valve push rod 3 actuates an outlet valve 4 which may be opened against the return force of a valve spring 5. Under normal operating conditions of the engine, the outlet valve 4 is opened by the cam 6 which lifts the outlet valve lifter 1 which, in return, transmits its movement, after exhausting a stroke 9, via the valve push rod 3 to the outlet valve 4.

During the braking operation of the engine the outlet valve 4 should be additionally lifted during the compression cycle in order to release compressed air so that additional braking work is performed.

Figure 2:
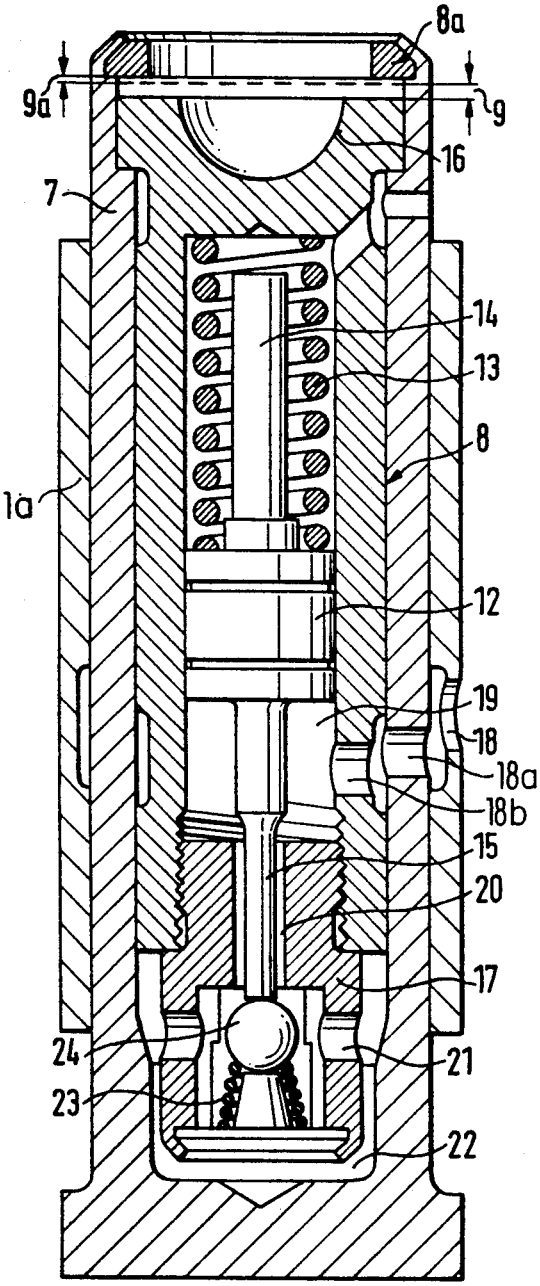
FIG. 2 shows an outlet valve lifter, having a mechanical abutment, in its initial position.

For this purpose, the outlet valve lifter 1 is provided with an outer portion 7 and an inner portion 8 which is axially slidable with a stroke 9 inside the outer portion 7. The outer portion 7 is slidable in a housing 1*a*. During the compression cycle, that is, when the outlet valve lifter 1 rests on a base circle 10 of the cam shaft 2, pressure medium is supplied from an external pressure source 11, having a relief pressure valve 11*a*, which lifts the inner portion 8 together with the valve push rod 3 until the inner portion 8 has performed the prescribed stroke 9, whereby a play 9*a* remains between the inner portion 8 and the annular abutment 8*a* (FIG. 2). The outlet valve 4 is thus opened and the compressed air is released. Since the outlet valve 4 in this cycle is lifted only to a small extent, at the end of the compression cycle a considerable pressure is generated within the cylinder which loads the outlet valve 4 in the direction of its closing position. The outlet valve 4 transmits this force via the valve push rod 3 to the inner portion 8 of the outlet valve lifter 1. Due to this force a high hydraulic pressure is generated within all pressurized parts which may cause damage to the device comprised of all interconnected parts as described above.

According to the present invention this increased hydraulic pressure acting on the outlet valve lifter is limited and may not be transmitted to the pressurized parts of the device.

According to FIG. 2 the inner portion 8 is of a special embodiment in order to prevent the action of increased hydraulic pressures onto the pressurized parts. For this purpose, the inner portion 8 is provided with an axially slidable piston 12 which is held in its initial position by a pressure spring 13 in which the piston 12 opens the valve seat 25. The piston 12, on the one hand, is equipped with a stroke limiting device 14 and on the other hand with a pin 15. The inner portion 8, at its upper end, is provided with a spherical cup 16 while the lower end is closed off by a ball valve 17. The spherical cup 16 serves to support the valve push rod 3 which is shown in FIG. 1. A first pressure chamber 19 arranged beneath the piston 12 is connected via bores 18, 18*a*, 18*b* to the external pressure source 11 (FIG. 1).

The first pressure chamber 19 also communicates in the initial position of the piston 12 via an axial bore 20 and connecting bores 21 provided within the valve 17 with the second pressure chamber 22 below the inner portion 8.

The ball valve 17 is comprised of a ball 24 and a spring 23 whereby the ball 24 is forced into a rest position by the pin 15 of the piston 12 via the pressure spring 13.

The inner portion 8 is guided within the outer portion 7 in a slidable manner and has a stroke 9 and a play 9*a* which is limited by the annular abutment 8*a*.

Figure 3:
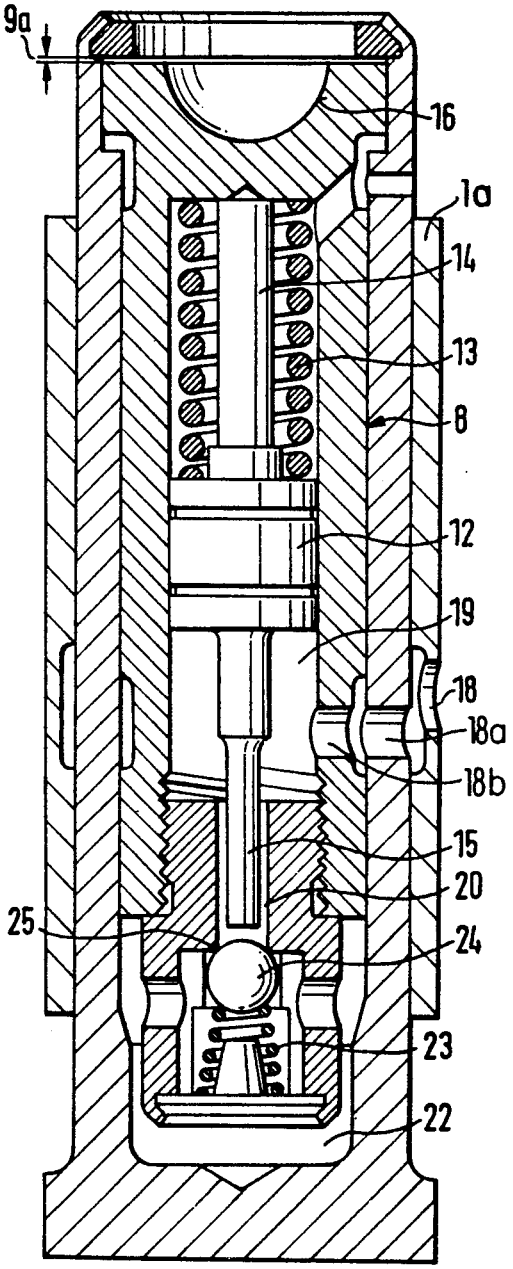
FIG. 3 is an outlet valve lifter with a mechanical abutment according to FIG. 2, shown in its operating position.

The function of the outlet valve lifter 1 will be explained with the aid of FIG. 3. When the motor brake is actuated, the first pressure chamber 19 is connected via the first, second and third bores 18, 18*a*, 18*b* with the external pressure source 11 shown in FIG. 1. When the pressure chamber 19 is pressurized by the pressure medium (oil), the pressure spring 13 is first compressed by the piston 12 until the stroke limiting device 14 in the form of an abutment contacts the inner portion 8. Simultaneously the ball 24 is no longer contacted by the pin 15 and is forced by the spring 23 into the valve seat 25, thereby closing off the valve seat 25, respectively, the axial bore 20.

The force of the spring 23 is determined such that the ball 24 may be opened by the pressure which is now generated in the first pressure chamber 19 so that the passage for the pressure medium via the axial bore 20 and the connecting bores 21 to the second pressure chamber 22 is opened. The force which is generated in the second pressure chamber 22 acts on the inner portion 8 so that the inner portion 8 together with the valve push rod 3 (FIG. 1), which is supported at the spherical cup 16, is lifted and moved until the stroke 9 (FIG. 2) is exhausted. The stroke 9 is a function of the amount of pressure medium supplied by the external pressure source 11. The amount of pressure medium supplied is a constant since the external pressure source 11 (FIG. 1) is in the form of a displacement pump. The opening of the outlet valve 4 (FIG. 1) thus corresponds to the stroke 9. Under normal operating conditions a play 9*a* remains between the inner portion 8 and the annular abutment 8*a*.

Since the opening of the outlet valve 4 occurs during the compression cycle of the engine the force acting in the closing direction of the outlet valve increases with increasing compression. This force is transmitted via the valve push rod 3 (FIG. 1) to the inner portion 8.

In order to maintain the outlet valve 4 in its open position against the increasing force within the cylinder of the combustion engine, the pressure generated by the external pressure source 11, resulting from the force acting on the inner portion 8 and its cross-sectional surface area, would have to be constantly increased. This would result in damage due to cavitation and leakage at the pressurized parts.

This is inventively prevented because the pressure which is built up within the second pressure chamber 22 forces the ball 24, in addition to the force of the spring 23, into the valve seat 25 so that the second pressure chamber 22 is tightly sealed and the constantly increasing pressure may not be transmitted via the axial bore 20 and the first, second and third bores 18, 18*a*, 18*b* to the further pressurized parts. Thus, the external pressure source 11 and the connecting lines are protected from increased pressure and its damaging effects. When the pressure which is generated by the external pressure source 11 decreases, the piston 12 moves the ball 24 away from the valve seat 25 of the ball valve 17 since the piston 12 is returned into its initial position. The pressure medium (oil) contained in the second pressure chamber 22 may now exit and the inner portion 8 and the outlet valve 4 are returned into their starting position, i.e., the lifting is terminated.

Figure 4:
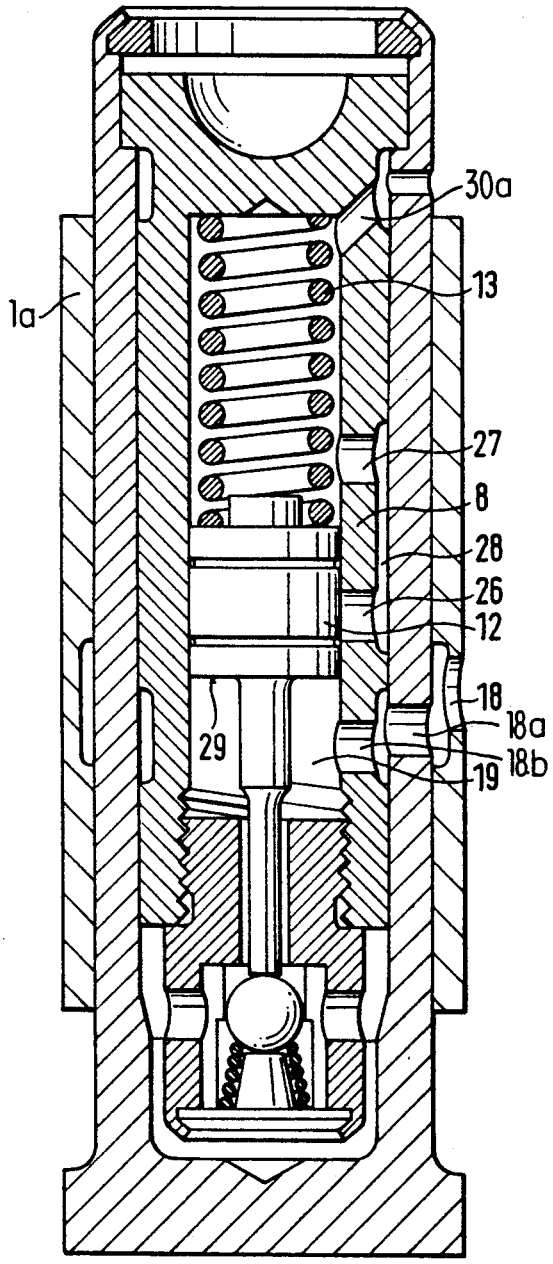
FIG. 4 is an outlet valve lifter with a hydraulic stroke limiting device in its initial position.
Figure 5:
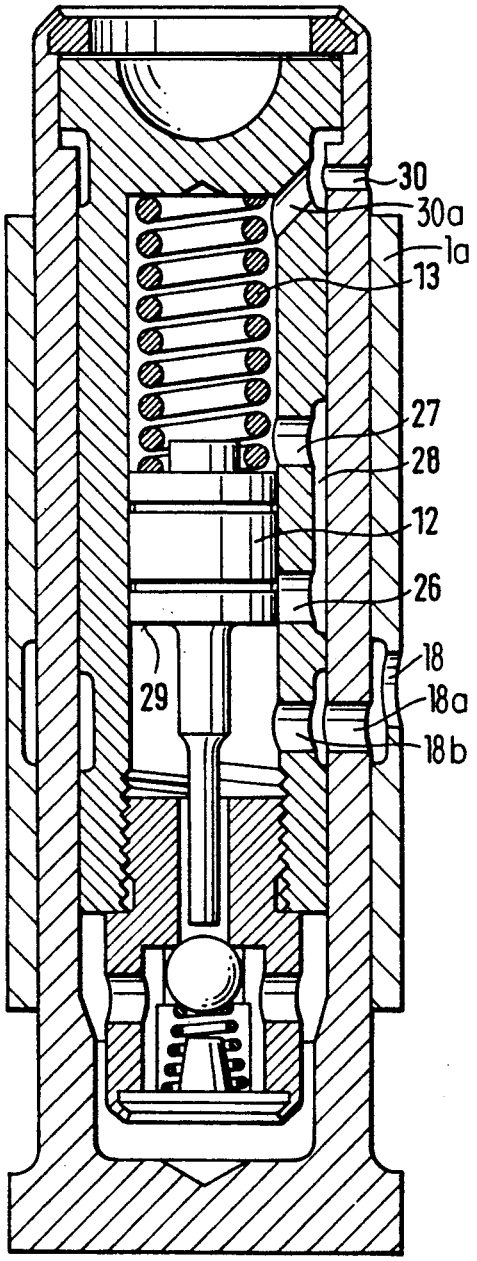
FIG. 5 shows an outlet valve lifter with a hydraulic stroke limiting device according to FIG. 4, in its operational position.

According to FIGS. 4 and 5 a hydraulic stroke limiting device may be employed instead of the mechanical abutment 14. For this purpose, the inner portion 8 is provided with first and second control bores 26, 27, as can be seen in FIG. 4. The first and second control bores 26, 27 are connected to one another by an overflow channel 28. In the initial position of the piston 12 the hydraulic pressure exerted via the bores 18, 18*a*, 18*b* may act on the piston 12 against the return force of the pressure spring 13 to thereby move the piston 12 in an upward direction toward the valve push rod. When the lower edge 29 of the piston 12 reaches the first control bore 26, shown in FIG. 5, the pressure medium (oil) may flow via the overflow channel 28 and the second control bore 27 into the space provided for the pressure spring 13. This space is connected via a relief bore 30 to the surroundings thereby providing a pressure compensation so that a further movement of the piston 12 is stopped. The function of the other parts corresponds to the embodiments of FIGS. 2 and 3 so that a further explanation is not necessary at this point. The embodiment shown in FIGS. 4 and 5 is advantageous because a relief pressure valve 11*a* is no longer required at the external pressure source (FIG. 1).

The present invention is, of course, in no way restricted to the specific disclosure of the specification and drawings, but also encompasses any modifications within the scope of the appended claims.

What we claim is:

1. An outlet valve lifter for an internal combustion engine, said outlet valve lifter being arranged between an outlet cam and a valve push rod connected to an outlet valve and being actuated by an external pressure source supplying comprising:

an outer portion and an inner portion, said inner portion being axially slidable with play in said outer portion and being actuated by pressure medium, said outer portion having a first radial bore and said inner portion having a second radial bore;

a housing in which said outer portion is axially slidable, said housing having a third radial bore connecting to said external pressure source;

a piston disposed axially slidable inside said inner portion;

a stroke limiting device in the area of a first end of said piston for limiting a stroke of said piston in a first direction toward the valve push rod;

a pin connected to a second end of said piston, said pin limiting the stroke of said piston in a second direction; initial position thereof;

a pressure spring arranged at said first end of said piston, said pressure spring forcing said piston in said second direction into an a ball valve connected to said inner portion in the area of said second end of said piston, said ball valve comprising a ball, a valve seat, a spring, connecting bores and an axial bore, said spring forcing said ball toward said piston into said valve seat, and with said pin of said piston being arranged in said axial bore and pressing against said ball in said initial position of said piston so that said valve seat is in an open position;

a first pressure chamber within said inner portion, said first pressure chamber being defined between said piston and said ball valve and communicating with said external pressure source via said first, second and third radial bores;

a second pressure chamber within said outer portion, said second pressure chamber being defined by inner walls of said outer portion and outer walls of said ball valve, said first and second pressure chambers communicating with one another via said axial bore, said valve seat and said connecting bores in said initial position of said piston;

wherein, when pressure medium is supplied, said piston, due to increasing pressure in said first pressure chamber, is moved against a force of said pressure spring in said first direction so that said ball is released and forced into said valve seat by said spring, thereby closing said valve seat, with a force of said spring being adjusted such that the pressure generated by the pressure medium is sufficient to remove said ball from said valve seat and to allow pressure medium to enter said second pressure chamber and lift said inner portion for opening the outlet valve via the valve push rod;

wherein, when back pressure from the outlet valve acting via the valve push rod on said inner portion causes a pressure increase in said second pressure chamber, said ball is forced into said valve seat thereby closing said valve seat and preventing backflow of pressure medium to said external pressure source; and wherein, when the pressure generated by the pressure medium decreases, said pressure spring forces said piston into said initial position, in which said pin forces said ball into said open position of said valve seat, so that pressure medium contained in said second pressure chamber flows out and lifting of said inner portion and the outlet valve is terminated.

2. An outlet valve lifter according to claim 1, wherein said stroke limiting device is an abutment which is fixedly connected to said piston.

3. An outlet valve lifter according to claim 1, further comprising an annular abutment, connected to said outer portion, for limiting the maximum stroke having a corresponding play of said inner portion in order to prevent a contacting of the outlet valve at an engine piston when the wherein said external pressure source further comprises a relief pressure valve for releasing excess pressure medium.

4. An outlet valve lifter according to claim 3, wherein the stroke is determined such that under normal braking conditions of the engine at a maximum additional stroke generated by said external pressure source a play exists between said inner portion and said annular abutment.

5. An outlet valve lifter according to claim 3, wherein said stroke limiting device is comprised of a first and a second control bore within said inner portion, an overflow channel connecting said first and said second control bores, and a relief bore within said outer portion, said first control bore being located within the area of said first pressure chamber such that, when a desired end position of said piston is reached, said first control bore is opened and said pressure chamber communicates via said overflow channel and said second control bore with said relief bore.

6. An outlet valve lifter according to claim 5, wherein said second control bore is arranged in the area of said pressure spring, and wherein said relief bore has a further portion of said pressure spring, whereby said second bore and said relief bore with said further portion communicate via a space of said inner portion in which said pressure spring is arranged.

* * * * *